US009056450B2

(12) United States Patent
Kennair et al.

(10) Patent No.: US 9,056,450 B2
(45) Date of Patent: Jun. 16, 2015

(54) METHOD OF MOUNTING A FLEXOGRAPHIC PRINTING PLATE WITH STRUCTURED PATTERNED BACKING TAPE

(71) Applicants: Terry P. Kennair, Houston, TX (US); Evan M. Goldberg, The Woodlands, TX (US)

(72) Inventors: Terry P. Kennair, Houston, TX (US); Evan M. Goldberg, The Woodlands, TX (US)

(73) Assignee: Uni-Pixel Displays, Inc., The Woodlands, TX (US)

( * ) Notice: Subject to any disclaimer, the term of this patent is extended or adjusted under 35 U.S.C. 154(b) by 197 days.

(21) Appl. No.: 13/784,765

(22) Filed: Mar. 4, 2013

(65) Prior Publication Data

US 2014/0245913 A1 Sep. 4, 2014

(51) Int. Cl.
*B41L 3/08* (2006.01)
*B41F 5/24* (2006.01)

(52) U.S. Cl.
CPC ..... *B41F 5/24* (2013.01)

(58) Field of Classification Search
CPC ..... B41F 5/24
USPC ..... 101/486
See application file for complete search history.

(56) References Cited

U.S. PATENT DOCUMENTS

| | | | | |
|---|---|---|---|---|
| 4,537,129 | A * | 8/1985 | Heinemann et al. | 101/415.1 |
| 4,589,338 | A | 5/1986 | Collins et al. | |
| 5,476,712 | A | 12/1995 | Hartman et al. | |
| 5,979,315 | A * | 11/1999 | Haan et al. | 101/181 |
| 6,343,550 | B1 * | 2/2002 | Feesler | 101/376 |
| 6,576,075 | B1 | 6/2003 | Hartman et al. | |
| 6,948,429 | B2 | 9/2005 | Kawaguchi et al. | |
| 7,807,001 | B2 * | 10/2010 | Zwadlo et al. | 156/64 |
| 8,071,269 | B2 | 12/2011 | Long et al. | |
| 8,252,514 | B2 | 8/2012 | Mclean et al. | |
| 8,313,888 | B2 | 11/2012 | Yoshimoto et al. | |
| 8,384,691 | B2 | 2/2013 | Frey et al. | |
| 2007/0068404 | A1 | 3/2007 | Hirahara et al. | |
| 2008/0055581 | A1 * | 3/2008 | Rogers et al. | 355/95 |
| 2010/0021695 | A1 * | 1/2010 | Naoyuki et al. | 428/173 |
| 2010/0129620 | A1 * | 5/2010 | Lopez-Mas et al. | 428/201 |

(Continued)

FOREIGN PATENT DOCUMENTS

| | | | |
|---|---|---|---|
| EP | 0222033 | A | 5/1987 |
| EP | 1060884 | A | 12/2000 |

OTHER PUBLICATIONS

Unknown, Mounting instructions D-3.PDF available at http://www.channalbac.com.

International Search Report of the International Searching Authority (Korea) for corresponding international application PCT/US2013/065878 dated Feb. 3, 2014.

(Continued)

*Primary Examiner* — Anthony Nguyen
(74) *Attorney, Agent, or Firm* — Basil M. Angelo

(57) ABSTRACT

A method of mounting a flexographic printing plate with structured patterned backing tape includes attaching a first end of a structured patterned backing tape to a printing plate cylinder at a scribe line. The structured patterned backing tape is wrapped around the printing plate cylinder. A second end of the structured patterned backing tape is cut at the scribe line. A first end of a flexographic printing plate is attached to the printing plate cylinder at an offset seam location ahead of the scribe line. The flexographic printing plate is wrapped around the printing plate cylinder. A second end of the flexographic printing plate is cut at the offset seam location.

10 Claims, 4 Drawing Sheets

(56) References Cited

U.S. PATENT DOCUMENTS

| | | | | |
|---|---|---|---|---|
| 2010/0282102 | A1 | 11/2010 | Mehdizadeh | |
| 2011/0045248 | A1 | 2/2011 | Hoffmuller et al. | |
| 2011/0249057 | A1 | 10/2011 | Dejoseph et al. | |
| 2011/0259221 | A1* | 10/2011 | Hargreaves et al. | 101/219 |
| 2012/0298000 | A1 | 11/2012 | Belfiore et al. | |

OTHER PUBLICATIONS

Mounting instructions D-3.PDF available at http://www.channalbac.com.

Written Opinion of the International Searching Authority (Korea) for corresponding international application PCT/US2013/065878 dated Feb. 3, 2014.

* cited by examiner

METHOD OF MOUNTING A FLEXOGRAPHIC PRINTING PLATE WITH STRUCTURED PATTERNED BACKING TAPE

BACKGROUND OF THE INVENTION

An electronic device with a touch screen allows a user to control the device by touch. The user may interact directly with the objects depicted on the display through touch or gestures. Touch screens are commonly found in consumer, commercial, and industrial devices including smartphones, tablets, laptop computers, desktop computers, monitors, gaming consoles, and televisions. A touch screen includes a touch sensor that includes a pattern of conductive lines disposed on a substrate.

Flexographic printing is a rotary relief printing process that transfers an image to a substrate. A flexographic printing process may be adapted for use in the fabrication of touch sensors. In addition, a flexographic printing process may be adapted for use in the fabrication of flexible and printed electronics ("FPE").

BRIEF SUMMARY OF THE INVENTION

According to one aspect of one or more embodiments of the present invention, a method of mounting a flexographic printing plate with structured patterned backing tape includes attaching a first end of a structured patterned backing tape to a printing plate cylinder at a scribe line. The structured patterned backing tape is wrapped around the printing plate cylinder. A second end of the structured patterned backing tape is cut at the scribe line. A first end of a flexographic printing plate is attached to the printing plate cylinder at an offset seam location ahead of the scribe line. The flexographic printing plate is wrapped around the printing plate cylinder. A second end of the flexographic printing plate is cut at the offset seam location.

According to one aspect of one or more embodiments of the present invention, a flexographic printing system includes a printing plate cylinder that includes a scribe line, structured patterned backing tape, and a flexographic printing plate. The structured patterned backing tape is wrapped around the printing plate cylinder at the scribe line. The flexographic printing plate is wrapped around the structured patterned backing tape at an offset seam location.

Other aspects of the present invention will be apparent from the following description and claims.

DETAILED DESCRIPTION OF THE INVENTION

Figure 1:
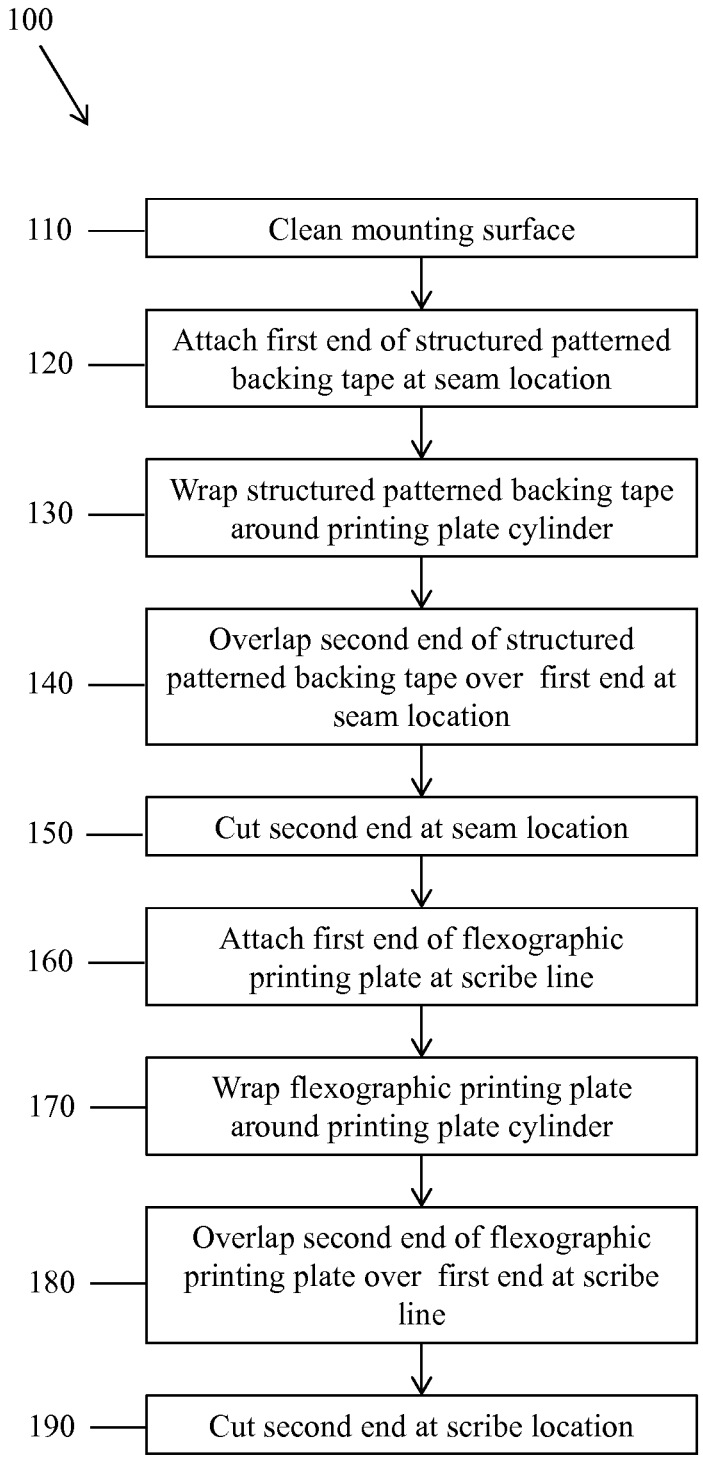
FIG. 1 PRIOR ART
FIG. 1 shows a conventional method of mounting a flexographic printing plate with structured patterned backing tape.

One or more embodiments of the present invention are described in detail with reference to the accompanying figures. For consistency, like elements in the various figures are denoted by like reference numerals. In the following detailed description of the present invention, specific details are set forth in order to provide a thorough understanding of the present invention. In other instances, well-known features to one of ordinary skill in the art are not described to avoid obscuring the description of the present invention.

In a conventional flexographic printing system, a flexographic printing plate, also referred to as a flexo master, is attached to a printing plate cylinder covered with cellular foam. Cellular foam encapsulates pockets of air in an elastomeric membrane forming micro balloons that provide cushion to the flexographic printing plate during the flexographic printing process. An impression cylinder applies pressure to a substrate that makes contact with the flexographic printing plate as the substrate moves through the system. The application of pressure over time may cause the cellular foam to fatigue and deform. The deformation may be inconsistent about the printing plate cylinder and may vary in amount and location. In addition to pressure deformation, the cellular foam may fatigue and deform from environmental causes, printing parameters, or prolonged use.

When the cellular foam deforms, the disposition of the flexographic printing plate on the printing plate cylinder may become uneven. Because of the imbalance, the printing plate cylinder may bounce. In addition, the flexographic printing plate may not transfer ink uniformly to the substrate. This problem is exacerbated as the line width and feature size of printing or embossing patterns on the flexographic printing plate decrease. In an attempt to compensate for this, the impression pressure may be increased. However, the increased impression pressure may crush the cellular foam. Once crushed, the flexographic printing plate and the cellular foam must be removed from the printing plate cylinder and the printing plate cylinder must be remounted with fresh cellular foam. Consequently, the state of the cellular foam is monitored during the flexographic printing process and the impression pressure is adjusted to compensate for deformation during long duration runs. Thus, the use of cellular foam negatively affects cost, print speed, print quality, and system uptime.

FIG. 1 shows a conventional method of mounting a flexographic printing plate 100 with structured patterned backing tape. In step 110, a mounting surface of the printing plate cylinder is cleaned and prepared for placement of a structured patterned backing tape. In step 120, a first end of the structured patterned backing tape is attached to the printing plate cylinder at a seam location that is approximately 3 to 4 inches away from a scribe line, also referred to as a cut line, which runs the length of the printing plate cylinder. In step 130, the structured patterned backing tape is wrapped around the printing plate cylinder. In step 140, a second end of the structured patterned backing tape overlaps the first end at the seam location that is approximately 3 to 4 inches away from the scribe line of the printing plate cylinder. In step 150, the second end of the structured patterned backing tape is cut at the seam location that is approximately 3 to 4 inches away from the scribe line of the printing plate cylinder. Because there is no cut line, it is difficult to keep the cut tight and the process of making the cut is more difficult. In the event the cut is not tight at the seam location, the gap in the structured patterned backing tape can cause printing irregularities and discontinuities. In step 160, a first end of a flexographic printing plate is attached to the printing plate cylinder at the scribe line. In step 170, the flexographic printing plate is wrapped around the printing plate cylinder. In step 180, a second end of the flexographic printing plate overlaps the first end at the scribe line. In step 190, the second end of the flexographic printing plate is cut in a tight seam such that the first end and second end of the flexographic printing plate meet at the scribe line.

The seam location of the structured patterned backing tape is located approximately 3 to 4 inches from the scribe line so there is no overlap between the seam location of the structured patterned backing tape and the seam location of the flexographic printing plate at the scribe line. Because the seams do not overlap, the flexographic printing plate may be removed and replaced without inadvertently removing the structured patterned backing tape. In addition, the flexographic printing plate may be repositioned during initial registration without lifting the structured patterned backing tape off the printing plate cylinder when putting the flexographic printing plate in register. In the event the seams overlap, there may be liftoff during high speed print operations.

Figure 2:
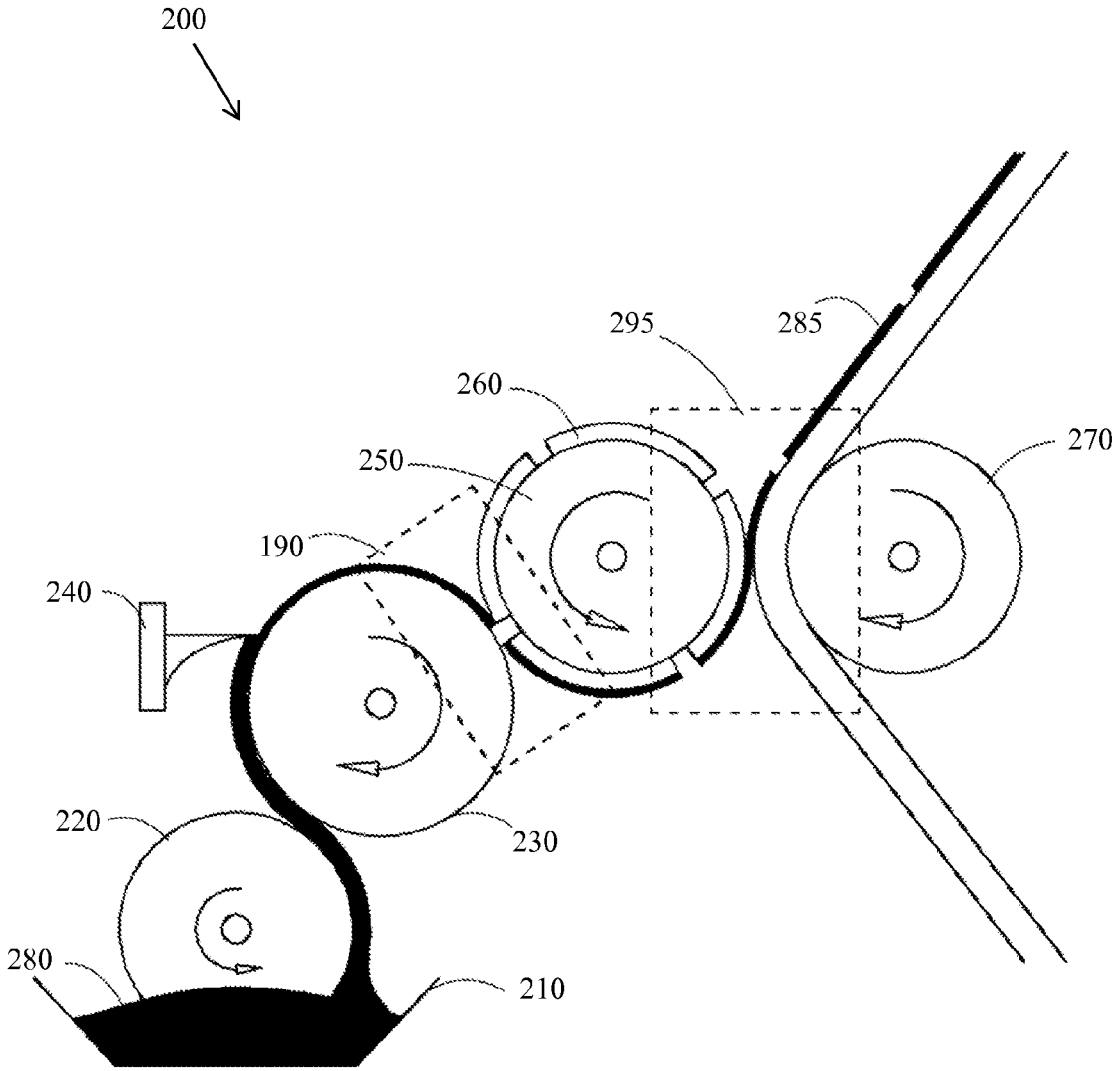
FIG. 2 shows a flexographic printing system in accordance with one or more embodiments of the present invention.

FIG. 2 shows a flexographic printing system 200 in accordance with one or more embodiments of the present invention. Flexographic printing system 200 may include an ink pan 210, an ink roll 220 (also referred to as a fountain roll), an anilox roll 230 (also referred to as a meter roll), a doctor blade 240, a printing plate cylinder 250, a flexographic printing plate 260, and an impression cylinder 270. Ink roll 220 transfers ink 280 from ink pan 210 to anilox roll 230.

Anilox roll 230 is typically constructed of a steel or aluminum core that may be coated by an industrial ceramic whose surface contains a plurality of very fine dimples, known as cells (not shown). Doctor blade 240 removes excess ink 280 from anilox roll 230. In transfer area 290, anilox roll 230 meters the amount of ink 280 transferred to flexographic printing plate 260 disposed on printing plate cylinder 250 to a uniform thickness. Printing plate cylinder 250 may be generally made of metal and the surface may be plated with chromium, or the like, to provide increased abrasion resistance. In one or more embodiments of the present invention, flexographic printing plate 260 may be attached to printing plate 250 by a structured patterned backing tape (not shown). In one or more embodiments of the present invention, flexographic printing plate 260 may be composed of a rubber or photo-polymer. A substrate 285 moves between the printing plate cylinder 250 and impression cylinder 270. Impression cylinder 270 applies pressure to printing plate cylinder 250, transferring an image from flexographic printing plate 260 to substrate 285 at transfer area 295. The rotational speed of printing plate cylinder 250 may be synchronized to match the speed at which substrate 285 moves through the flexographic printing system 200. In one or more embodiments of the present invention, the speed may vary between approximately 20 feet per minute to approximately 750 feet per minute.

In one or more embodiments of the present invention, the flexographic printing system may use an ink suitable for printing a patterned ink seed layer on the substrate. In one or more embodiments of the present invention, the ink may be a catalytic ink that serves as a base layer capable of being electroless plated. In one or more embodiments of the present invention, the ink may be a catalytic alloy ink that serves as a base layer capable of being electroless plated. One of ordinary skill in the art will recognize that other catalytic inks and catalytic alloy inks are within the scope of one or more embodiments of the present invention.

In one or more embodiments of the present invention, the printed patterned ink seed layer includes a plurality of seed conductors suitable for electroless plating. In one or more embodiments of the present invention, the printed patterned ink seed conductors may be arranged in a micro mesh. In one or more embodiments of the present invention, the printed patterned ink seed conductors may be arranged in a micro mesh of row conductors and column conductors that are co-planar and perpendicular to one another. One of ordinary skill in the art will recognize that other micro mesh configurations are within the scope of one or more embodiments of the present invention. In one or more embodiments of the present invention, a width of the printed patterned ink seed conductors may be in a range suitable for use in touch sensors. In one or more embodiments of the present invention, a width of the printed patterned ink seed conductors may be in a range between approximately 1 micron to approximately 9 microns. In one or more embodiments of the present invention, a width of the printed patterned ink seed conductors may be in a range between approximately 10 microns to approximately 20 microns. In one or more embodiments of the present invention, a width of the printed patterned ink seed conductors may be greater than 20 microns. In one or more embodiments of the present invention, the printed patterned ink seed layers may serve as the base layers for conductors of a touch sensor after electroless plating.

In one or more embodiments of the present invention, substrate 285 may be rigid. In one or more embodiments of the present invention, substrate 285 may be flexible. In one or more embodiments of the present invention, substrate 285 may be opaque. In one or more embodiments of the present invention, substrate 285 may be transparent. In one or more embodiments of the present invention, transparent means the transmission of light with a transmittance rate of 90% or more. In one or more embodiments of the present invention, substrate 285 may be polyethylene terephthalate ("PET"). In one or more embodiments of the present invention, substrate 285 may be polyethylene naphthalate ("PEN"). In one or more embodiments of the present invention, substrate 285 may be cellulose acetate ("TAC"). In one or more embodiments of the present invention, substrate 285 may be linear low-density polyethylene ("LLDPE"). In one or more embodiments of the present invention, substrate 285 may be bi-axially-oriented polypropylene ("BOPP"). In one or more embodiments of the present invention, substrate 285 may be a polyester substrate. In one or more embodiments of the present invention, substrate 285 may be a thin glass substrate. In one or more embodiments of the present invention, substrate 285 may be a polypropylene, foam, paper, aluminum, or foil. One of ordinary skill in the art will recognize that other substrates are within the scope of one or more embodiments of the present invention.

Figure 3:
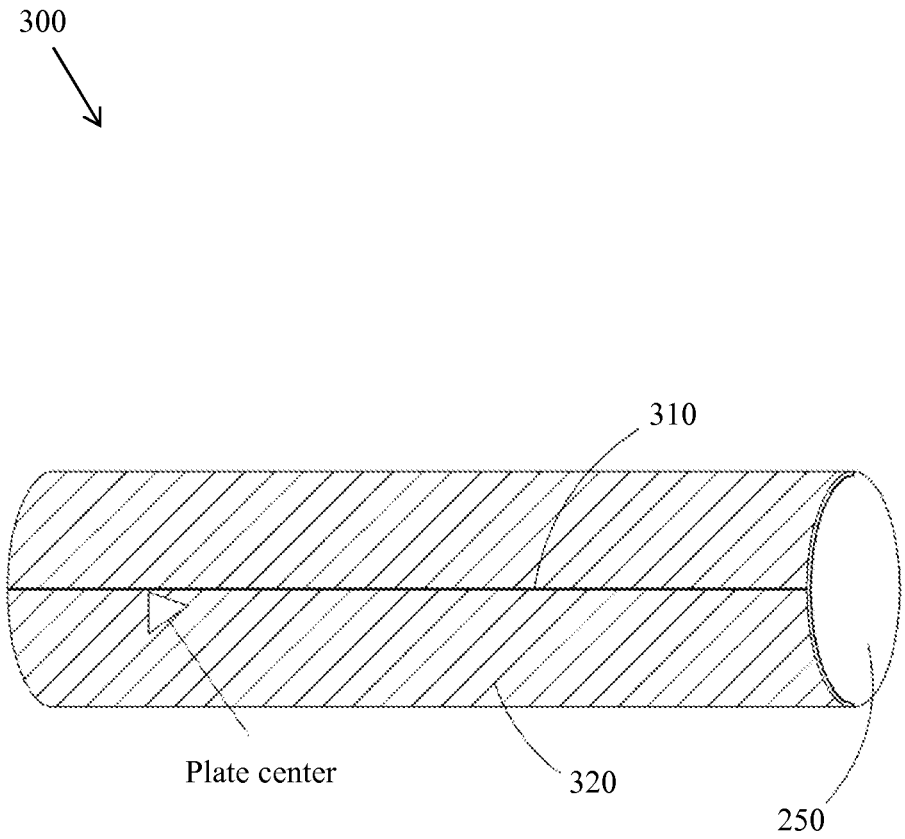
FIG. 3 shows a structured patterned backing tape on a printing plate cylinder in accordance with one or more embodiments of the present invention.

FIG. 3 shows a structured patterned backing tape on a printing plate cylinder 300 in accordance with one or more embodiments of the present invention. Printing plate cylinder 250 includes scribe line 310 along the longitude of printing plate cylinder 250. Scribe line 310 is an indentation that may be used to locate the plate center of printing plate cylinder 250 and make a clean cut.

In one or more embodiments of the present invention, scribe line 310 may be used as a guide to start and finish wrapping structured patterned backing tape 320 around printing plate cylinder 250. In one or more embodiments of the present invention, scribe line 310 may be used as a guide to start placement of structured patterned backing tape 320, which is then wrapped around printing plate cylinder 250. In one or more embodiments of the present invention, scribe line 310 may be used as a guide to finish placement of structured patterned backing tape 320 at scribe line 310 after wrapping. In one or more embodiments of the present invention, excess structured patterned backing tape 320 may extend beyond the finish at scribe line 310. In one or more embodiments of the present invention, the excess structured patterned backing tape 320 may be removed by making a cut on structured patterned backing tape 320 along the longitude of printing plate cylinder 250 at scribe line 310. In one or more embodiments of the present invention, structured patterned backing tape 320 may be wrapped around printing plate cylinder 250 starting at scribe line 310 and the excess structured patterned backing tape 320 is cut along the seam at scribe line 310 without overlap or gap. In one or more embodiments of the present invention, structured patterned backing tape 320 may be wrapped around printing plate cylinder 250 in a rotational direction or across the cylinder face. In one or more embodiments of the present invention, structured patterned backing tape 320 adheres to printing plate cylinder 250 by an adhesive disposed on a first side of structured patterned backing tape 320. In one or more embodiments of the present invention, a flexographic printing plate adheres to structured patterned backing tape 320 by an adhesive disposed on a second side of structured patterned backing tape 320.

In one or more embodiments of the present invention, structured patterned backing tape 320 may comprise ChannalBAC™ structured patterned backing tape commercially available from Controlled Displacement™ Technology LLC of Parkland, Fla. ChannalBAC™ differs from cellular foam in that ChannalBAC™ completely separates the air and elastomeric components by forming solid elastomeric channels separated by channels of air within its membrane. As such, ChannalBAC™ cannot be crushed like cellular foam and resists fatigue and deformation in a spring-like manner. Because of the more uniform density and resistance when compared to cellular foam, ChannalBAC™ provides a more uniform and consistent transfer of ink from the flexographic printing plate to the substrate. When placed on printing plate cylinder 250, the elastomeric channels are aligned at a 45-degree angle with respect to scribe line 310. When impression pressure is increased, the elastomeric channels of ChannalBAC™ displace in a path of least resistance, resulting in movement of the elastomer across the rotational direction of printing plate cylinder 250. Because of the controlled displacement of the elastomeric channels, ChannalBAC™ provides a more uniform and consistent transfer of ink from the flexographic printing plate to the substrate. In addition, because of the more even distribution of pressure, there is no need to increase impression pressure during long production runs.

In one or more embodiments of the present invention, structured patterned backing tape 320 may serve as a shock absorber and cushion for use between the flexographic printing plate and printing plate cylinder during printing. In one or more embodiments of the present invention, structured patterned backing tape 320 may compensate for variations in thickness and height. In one or more embodiments of the present invention, structured patterned backing tape 320 may maintain centricity of the flexographic printing plate and printing plate cylinder. In one or more embodiments of the present invention, structured patterned backing tape 320 may prevent distortions in the image being printed from the flexographic printing plate to the substrate. In one or more embodiments of the present invention, structured patterned backing tape 320 may reduce printing plate cylinder bounce.

Figure 4:
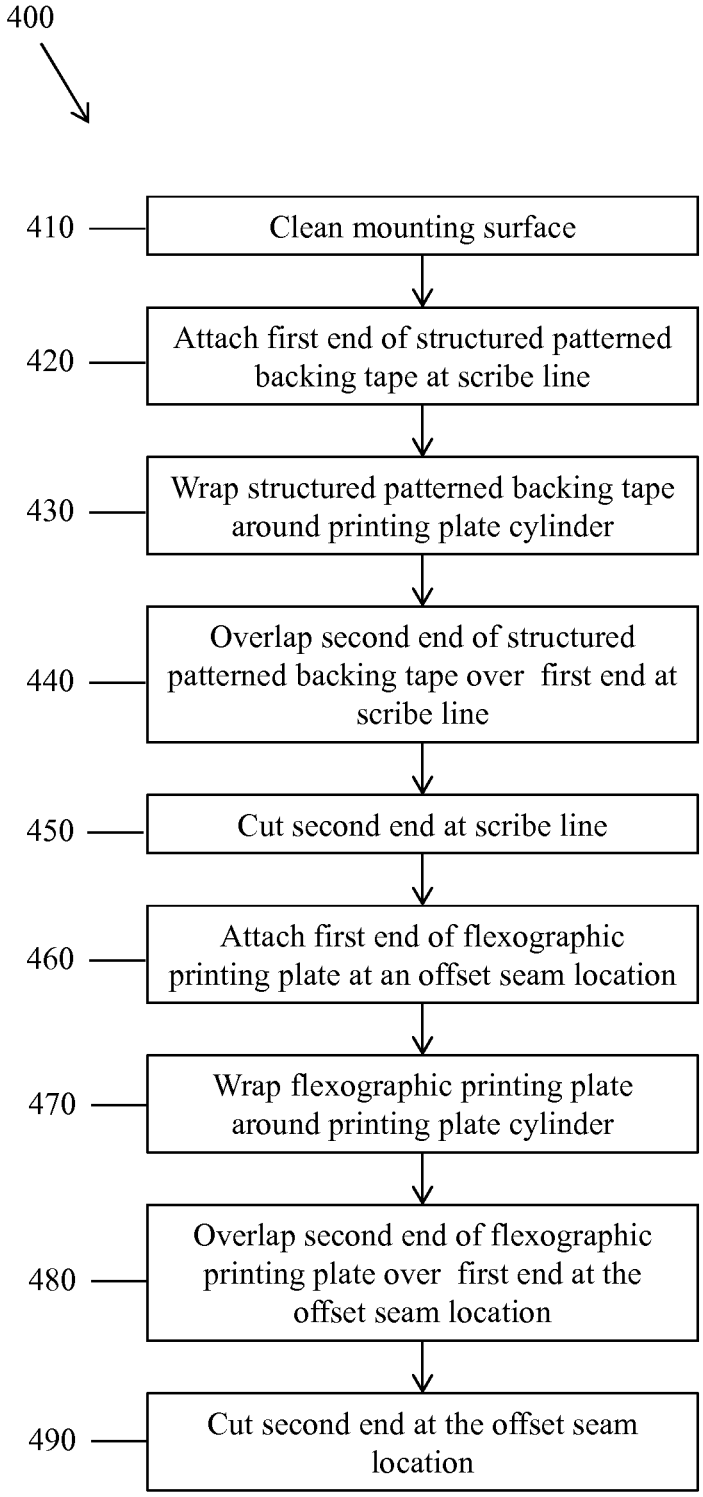
FIG. 4 shows a method of mounting a flexographic printing plate with structured patterned backing tape in accordance with one or more embodiments of the present invention.

FIG. 4 shows a method of mounting a flexographic printing plate with structured patterned backing tape in accordance with one or more embodiments of the present invention. In step 410, a mounting surface of the printing plate cylinder may be cleaned and prepared for placement of a structured patterned backing tape. In step 420, a first end of the structured patterned backing tape may be attached to the printing plate cylinder at the scribe line of the printing plate cylinder. In step 430, the structured patterned backing tape may be wrapped around the printing plate cylinder. In step 440, a second end of the structured patterned backing tape may overlap the first end at the scribe line of the printing plate cylinder. In step 450, the second end of the structured patterned backing tape may be cut in a tight seam such that the first end and second end of the structured patterned backing tape meet at the scribe line of the printing plate cylinder without overlap or gap. In step 460, a first end of a flexographic printing plate may be attached to the printing plate cylinder at a seam location that is offset from the scribe line. In one or more embodiments of the present invention, the first end of the flexographic printing plate may be attached to an 18 inch 151 tooth drum-type printing plate cylinder at a seam location that is offset approximately 4.5 inches ahead of the scribe line. One of ordinary skill in the art will recognize that the offset may vary in accordance with the type and dimensions of the printing plate cylinder used. In step 470, the flexographic printing plate is wrapped around the printing plate cylinder. In step 480, a second end of the flexographic printing plate overlaps the first end at the seam location offset and ahead of the scribe line. In step 490, the second end of the flexographic printing plate is cut in a tight seam such that the first end and second end of the flexographic printing plate meet at the offset seam location.

When the flexographic printing plate includes embossing patterns comprised of micron-fine lines and features, the scribe line of the printing plate cylinder may create a band in the printing area between the scribe line and the offset seam location of the flexographic printing plate. If there are embossing patterns in this area, the band may distort the printing patterns. For example, a 5 micron wide line printed in the band area may result in a printed line of 10 or more microns in width. The band may occur when the anilox roll hits the scribe line, giving rise to a bump that tends to distort the printing patterns located in the band area. The band may create irregularities or discontinuities in the printed pattern on the substrate. These irregularities or discontinuities negatively affect the integrity and function of the printed patterns on the substrate. In one or more embodiments of the present invention, the structured patterned backing tape may be aligned at the scribe line of the printing plate cylinder. In one or more embodiments of the present invention, aligning the structured patterned backing tape at the scribe line allows for quick and easy placement, removal, and replacement of the structured patterned backing tape on the printing plate cylinder. In one or more embodiments of the present invention, aligning the structured patterned backing tape at the scribe line allows for an easy cut of the structured patterned backing tape. In one or more embodiments of the present invention, the flexographic printing plate may be aligned at a seam location that is offset from the scribe line. In one or more embodiments of the present invention, the offset seam location of an 18 inch 151 tooth drum-type printing plate cylinder may be 4.5 inches ahead of the scribe line. In one or more embodiments of the present invention, aligning the flexographic printing plate at the offset seam location ahead of the scribe line hides the band in a dead zone that may not include embossing patterns. In one or more embodiments of the present invention, the seam location of the structured patterned backing tape at the scribe line and the offset seam location of the flexographic printing plate ahead of the scribe line do not overlap. In one or more embodiments of the present invention, the flexographic printing plate may be removed and replaced without inadvertently removing the structured patterned backing tape.

Advantages of one or more embodiments of the present invention may include one or more of the following:

In one or more embodiments of the present invention, a method of mounting a flexo master with structured patterned backing tape allows for flexographic printing of uniform micron-fine lines and features.

In one or more embodiments of the present invention, a method of mounting a flexo master with structured patterned backing tape allows for flexographic printing of uniform micron-fine lines and features over a large area.

In one or more embodiments of the present invention, a method of mounting a flexo master with structured patterned backing tape increases flexographic printing speed of uniform micron-fine lines and features over a large area.

In one or more embodiments of the present invention, a method of mounting a flexo master with structured patterned backing tape reduces flexographic printing plate mounting time.

In one or more embodiments of the present invention, a method of mounting a flexo master with structured patterned backing tape provides an even distribution of pressure between a flexographic printing plate and printing plate cylinder.

In one or more embodiments of the present invention, a method of mounting a flexo master with structured patterned backing tape decreases printing plate cylinder bounce.

In one or more embodiments of the present invention, a method of mounting a flexo master with structured patterned backing tape maintains centricity of the flexographic printing plate and printing plate cylinder.

In one or more embodiments of the present invention, a method of mounting a flexo master with structured patterned backing tape extends flexographic printing plate life.

In one or more embodiments of the present invention, a method of mounting a flexo master with structured patterned backing tape allows for constant impression during long production runs.

In one or more embodiments of the present invention, a method of mounting a flexo master with structured patterned backing tape eliminates the need for increased impression during long production runs.

In one or more embodiments of the present invention, a method of mounting a flexo master with structured patterned backing tape prevents distortions in an image transferred to a substrate In one or more embodiments of the present invention, a method of mounting a flexo master with structured patterned backing tape compensates for variations in thickness.

In one or more embodiments of the present invention, a method of mounting a flexo master with structured patterned backing tape compensates for variations in height.

In one or more embodiments of the present invention, a method of mounting a flexo master with structured patterned backing tape prevents tape crushing during long production runs.

In one or more embodiments of the present invention, a method of mounting a flexo master with structured patterned backing tape increases flexographic printing speed.

In one or more embodiments of the present invention, a method of mounting a flexo master with structured patterned backing tape improves the flexographic printing of fine lines and features having a width in a range between 1 micron and 9 microns.

In one or more embodiments of the present invention, a method of mounting a flexo master with structured patterned backing tape improves the flexographic printing of fine lines and features having a width in a range between 10 microns and 20 microns.

In one or more embodiments of the present invention, a method of mounting a flexo master with structured patterned backing tape improves the flexographic printing of fine lines and features having a width greater than 20 microns.

In one or more embodiments of the present invention, a method of mounting a flexo master with structured patterned backing tape is compatible with existing flexographic printing processes and systems.

In one or more embodiments of the present invention, a method of mounting a flexo master with structured patterned backing tape allows for the fabrication of improved touch sensors.

While the present invention has been described with respect to the above-noted embodiments, those skilled in the art, having the benefit of this disclosure, will recognize that other embodiments may be devised that are within the scope of the invention as disclosed herein. Accordingly, the scope of the invention should be limited only by the appended claims.

What is claimed is:

1. A method of mounting a flexographic printing plate with structured patterned backing tape comprising:

attaching a first end of the structured patterned backing tape to a printing plate cylinder at a scribe line of the printing plate cylinder;

wrapping the structured patterned backing tape around the printing plate cylinder;

cutting a second end of the structured patterned backing tape at the scribe line;

attaching a first end of the flexographic printing plate to the printing plate cylinder at an offset seam location relative to the scribe line;

wrapping the flexographic printing plate around the printing plate cylinder; and cutting a second end of the flexographic printing plate at the offset seam location, wherein the offset seam location is approximately 4.5 inches offset relative to the scribe line.

2. The method of claim 1, further comprising:

cleaning a mounting surface of the printing plate cylinder.

3. The method of claim 1, wherein the structured patterned backing tape comprises ChannalBAC™.

4. The method of claim 1, wherein the structured patterned backing tape comprises an adhesive layer.

5. The method of claim 1, wherein wrapping the structured patterned backing tape comprises overlapping the second end of the structured patterned backing tape over the first end of the structured patterned backing tape at the scribe line.

6. The method of claim 1, wherein the second end of the structured patterned backing tape meets the first end of the structured patterned backing tape at the scribe line without gap after cutting.

7. The method of claim 1, wherein wrapping the flexographic printing plate comprises overlapping the second end of the flexographic printing plate over the first end of the flexographic printing plate at the offset seam location.

8. The method of claim 1, wherein the second end of the flexographic printing plate meets the first end of the flexographic printing plate at the offset seam location without gap after cutting.

9. The method of claim 1, wherein the flexographic printing plate comprises embossing patterns of micron-fine lines or features.

10. The method of claim 9, wherein the embossing patterns comprise lines or features having a width in a range between approximate 1 micron and 9 microns.

* * * * *